US008490534B1

(12) United States Patent
Moore

(10) Patent No.: US 8,490,534 B1
(45) Date of Patent: Jul. 23, 2013

(54) FLASH HIDER

(75) Inventor: Charles Moore, Columbia, SC (US)

(73) Assignee: FN Manufacturing, LLC, Columbia, SC (US)

( * ) Notice: Subject to any disclaimer, the term of this patent is extended or adjusted under 35 U.S.C. 154(b) by 190 days.

(21) Appl. No.: 13/211,405

(22) Filed: Aug. 17, 2011

Related U.S. Application Data

(60) Provisional application No. 61/375,339, filed on Aug. 20, 2010, provisional application No. 61/375,530, filed on Aug. 20, 2010, provisional application No. 61/375,620, filed on Aug. 20, 2010.

(51) Int. Cl.
*F41A 21/00* (2006.01)

(52) U.S. Cl.
USPC ..... 89/14.2; 89/14.3; 89/14.4; 181/223; 42/1.06

(58) Field of Classification Search
USPC ..... 89/14.4, 14.3, 14.2; 181/223; 42/1.06, 42/79
See application file for complete search history.

(56) References Cited

U.S. PATENT DOCUMENTS

| | | | | | |
|---|---|---|---|---|---|
| 1,017,003 | A * | 2/1912 | Kenney | 181/223 |
| 2,870,679 | A | 1/1959 | Collins | |
| 3,710,679 | A * | 1/1973 | Werbell, III | 89/14.4 |
| 4,664,014 | A | 5/1987 | Hawley et al. | |
| 5,361,677 | A * | 11/1994 | Warner et al. | 89/14.2 |
| 5,596,161 | A | 1/1997 | Sommers | |
| 5,883,328 | A | 3/1999 | A'Costa | |
| 6,308,609 | B1 * | 10/2001 | Davies | 89/14.4 |
| 7,073,426 | B1 * | 7/2006 | White | 89/14.4 |
| 7,237,467 | B1 * | 7/2007 | Melton | 89/14.4 |
| 7,302,774 | B2 | 12/2007 | Meyers | |
| 7,308,967 | B1 * | 12/2007 | Hoel et al. | 181/223 |
| 7,412,917 | B2 | 8/2008 | Vais | |
| 7,516,690 | B2 * | 4/2009 | McClellan | 89/14.4 |
| 7,587,969 | B2 * | 9/2009 | Silvers | 89/14.4 |
| 7,594,464 | B2 * | 9/2009 | Dueck | 89/14.4 |
| 7,832,323 | B1 * | 11/2010 | Davies | 89/14.4 |
| 7,874,238 | B2 * | 1/2011 | Silvers | 89/14.4 |
| 7,905,170 | B1 * | 3/2011 | Brittingham et al. | 89/14.2 |
| 7,926,404 | B2 * | 4/2011 | Brittingham | 89/14.2 |
| 8,096,222 | B2 * | 1/2012 | Silvers | 89/14.4 |
| 8,167,084 | B1 * | 5/2012 | Moore | 181/223 |
| 2007/0266844 | A1 * | 11/2007 | Dueck | 89/14.4 |
| 2008/0148928 | A1 * | 6/2008 | McClellan | 89/14.4 |
| 2010/0275769 | A1 * | 11/2010 | Brittingham | 89/193 |
| 2011/0072958 | A1 * | 3/2011 | Brittingham et al. | 89/14.2 |
| 2012/0272818 | A1 * | 11/2012 | Dueck et al. | 89/14.4 |

* cited by examiner

*Primary Examiner* — Michael David
(74) *Attorney, Agent, or Firm* — Michael A. Mann; Nexsen Pruet, LLC

(57) ABSTRACT

A flash hider has a central bore for receiving the barrel of a firearm at one end and three tapered tines at the opposing end with a gap formed between each pair of adjacent tines. Just past the muzzle-seat in the central bore is a flared entrance leading to the gaps thereby allowing hot air and combustion gases to expand radially through the gaps between the tines, thereby cooling the hot air and gases. The lateral faces of the tines are stepped to cause turbulent mixing of the cooler air surrounding the flash hider with the exiting gases so as to further expand and cool in order to prevent re-ignition and thereby reduce secondary flash. Long tines help to hide all but direct viewing of primary flash.

14 Claims, 6 Drawing Sheets

FLASH HIDER

PRIORITY CLAIM

Priority is claimed to U.S. provisional patent application Ser. No. 61/375,339, filed Aug. 20, 2010. U.S. provisional patent application Ser. No. 61/375,530 and U.S. provisional patent application Ser. No. 61/375,620, both filed on Aug. 20, 2010, are related to this application. Provisional applications 61/375,339, 61/375,530, and 61/375,620, are incorporated herein by reference in their entirety.

SUMMARY OF THE INVENTION

The present invention is a flash hider for use with the barrel of a firearm to reduce the flash that would otherwise occur when the firearm is fired. The flash hider comprises a generally cylindrical tube having a wall with a central hole formed therein. One end of the flash hider has interior threads and is dimensioned for threadably receiving a barrel of a firearm; and a second, opposing end terminates in three tines around the central bore. The three tines define three gaps in the flash hider wall. Each tine has an interior face, an exterior face, two lateral faces that face the adjacent gaps. Hot air and combustion gases from the barrel enter the first end of the flash hider and, as they move toward the second end, are urged to expand in a direction radially away from the centerline of the center bore by a 45-degree flared entrance formed in the central bore and which opens into the three gaps in the flash hider wall. Several features of the present flash hider contribute to the rapid cooling of hot combustion gases. The lateral faces of each tine carry at least one step to cause these exiting gases to tumble and swirl together, mixing with cooler air in the vicinity of, but external to, the flash hider so that they cool quickly thereby avoiding re-ignition and thereby reduce the flash. The steps on the lateral faces also expand the gaps' width in the radial direction, and, along with the taper of the tines, expand the width of the gaps in the axial direction. The long flash hider tines also help to hide the primary flash from all but a substantially end view.

BRIEF DESCRIPTION OF THE DRAWINGS

In the figures.

DETAILED DESCRIPTION OF VARIOUS EMBODIMENTS

A flash hider is a device that is attached to the end of the barrel of a firearm in order to reduce the flash that is associated with firing a round of ammunition. The flash acts unintentionally as a signal of the location of the firearm. Reducing the flash may help the marksman who fired the firearm to avoid giving away his location, which is important to his safety and who may be an infantry soldier. Protecting concealment may be especially important to infantry snipers.

When a firearm is fired, there is a primary flash and a secondary flash. The primary flash is from the initial explosion of the charge and travels down the barrel and through the central bore of the flash hider. The secondary flash is caused by the collision between the pulse of air and combustion gases traveling at supersonic speed down the barrel with the comparatively still and cooler air outside the barrel. The collision heats and re-ignites the combustion gas/air mixture.

While the secondary flash may not be eliminated entirely, it is lessened by the present flash hider. In the accompanying FIGS. 1-22, there are shown two embodiments of a flash hider, one for each of two different types of ammunition. A first flash hider 110 is shown in FIGS. 1-11; a second flash hider 210 is shown in FIGS. 12-22.

Figure 1:
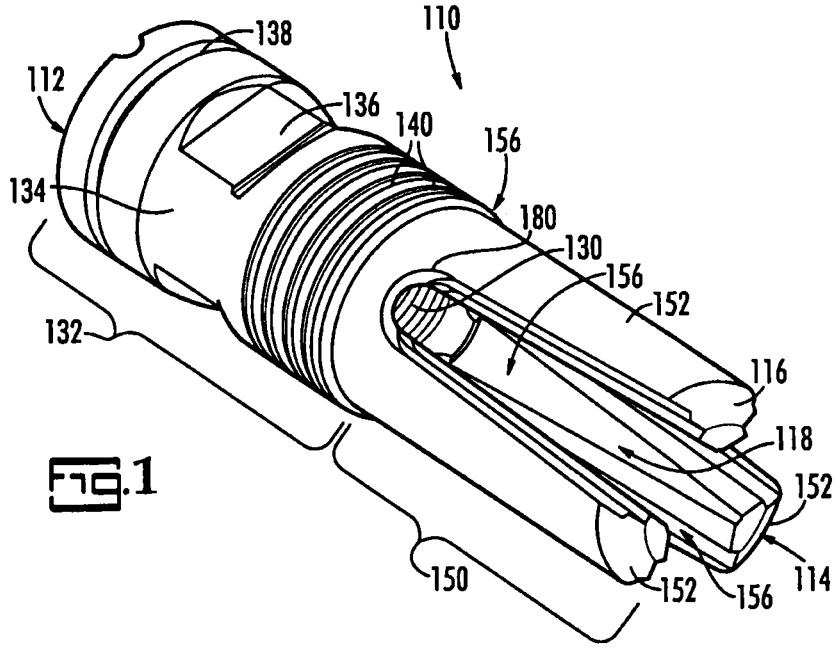
FIG. 1 shows a perspective view from the second end of a flash hider, according to an embodiment of the present invention.
Figure 2:
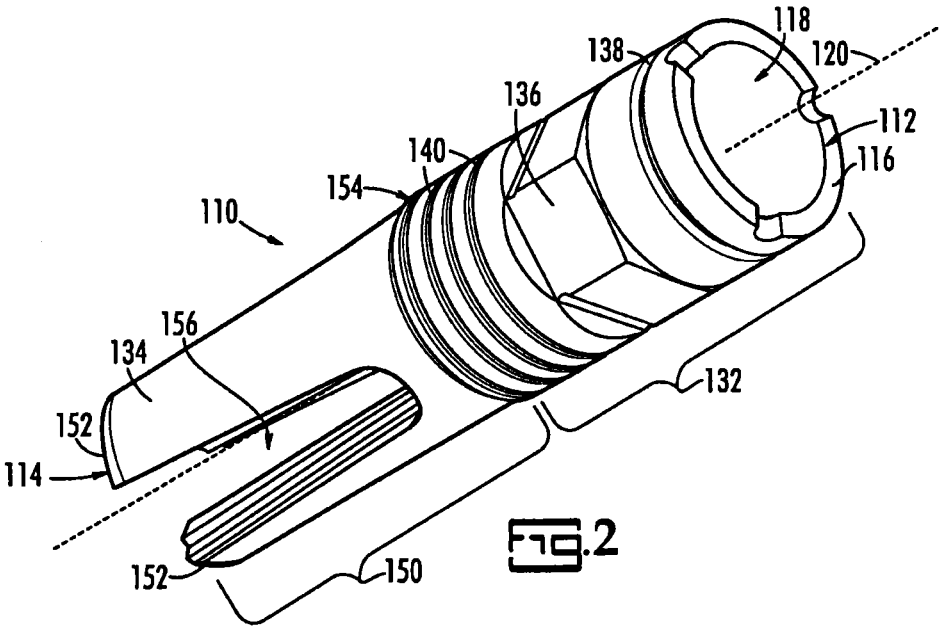
FIG. 2 shows a perspective view from the first end of the flash hider of FIG. 1, according to the embodiment shown in FIG. 1.
Figure 3:
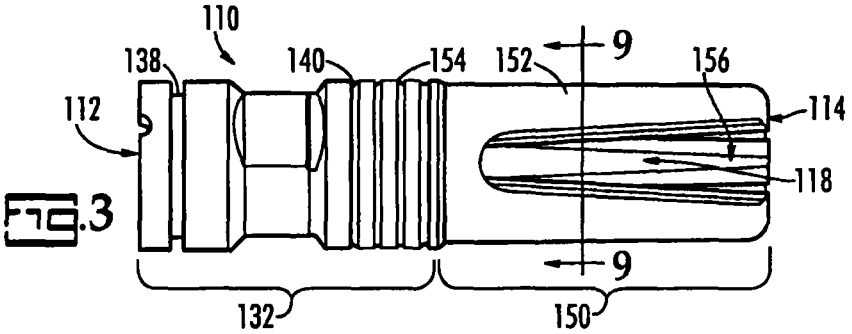
FIG. 3 shows a side view of an embodiment of the flash hider of FIG. 1.
Figure 4:
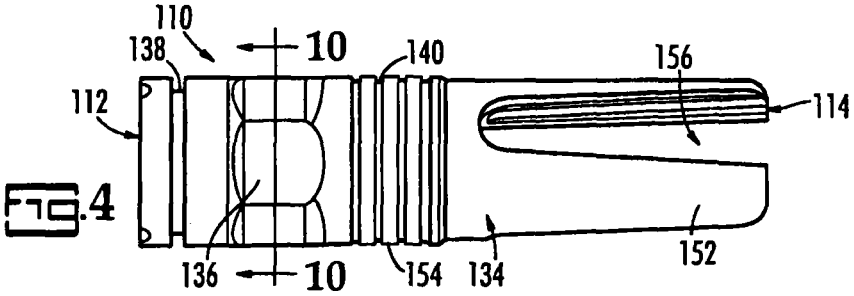
FIG. 4 is a view of the obverse side of the flash hider of FIG. 3.
Figure 5:
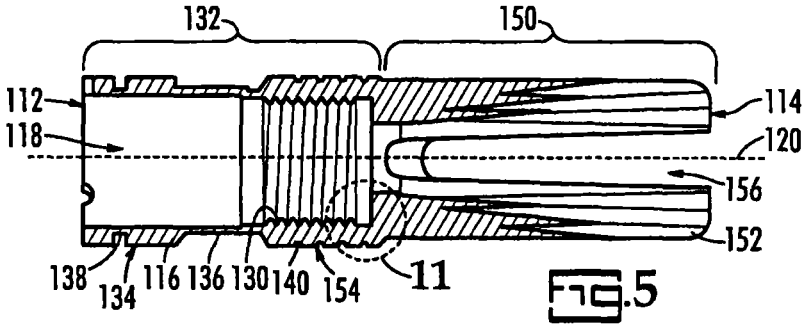
FIG. 5 is a side, cross-sectional view of the flash hider taken along lines 5-5 of FIG. 7.
Figure 6:
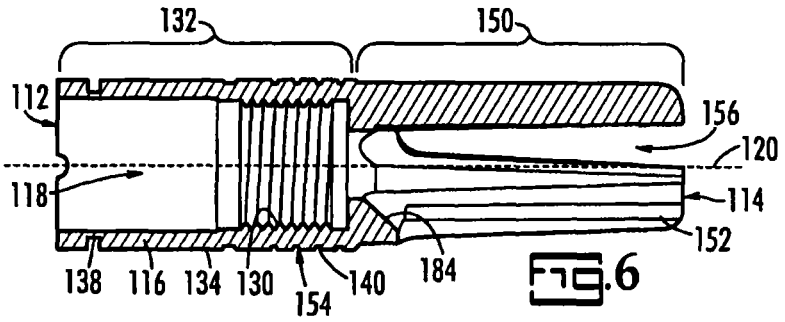
FIG. 6 is a side, cross-sectional view of the flash hider of FIG. 4.
Figure 7:
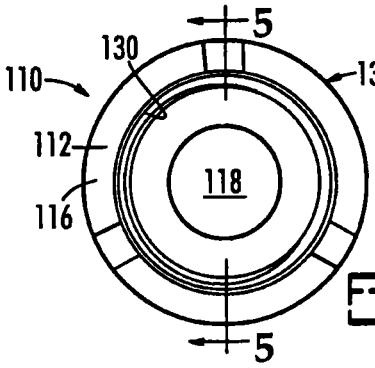
FIG. 7 is an end view of an embodiment of a flash hider of FIG. 2.
Figure 8:
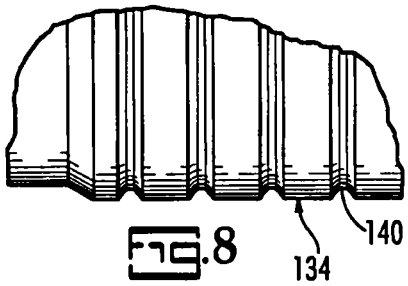
FIG. 8 is a detail of exterior side view of the flash hider of FIG. 1.

Referring now to FIGS. 1-11, flash hider 110 has a first end 112 and an opposing second end 114. Flash hider 110 is a generally cylindrical tube with a wall 116 with a central bore 118 with a major axis 120, which axis 120 is best seen in FIGS. 2, 5 and 6.

First end 112 is dimensioned to receive the threaded end of a barrel of a firearm. Accordingly, flash hider 110 has interior threads 130 carried by a first portion 132 of central bore 118 dimensioned for the threads on the end of the barrel. It is convenient for flash hider 110 to have at least two opposing facets 136 on its exterior surface 134, and possibly as many as six exterior facets 136 about first portion 132. Facets 136 are flattened areas formed on the otherwise generally cylindrical exterior surface 134 of flash hider and facilitate use of a wrench or other tool to rotate flash hider 110 with respect to the barrel of the firearm.

Flash hider 110 may have an annular recess 138 for receiving O-rings for attaching various auxiliary devices such as a rifle grenade and annular grooves 140 for forming a gas-tight seal against the interior of a sound suppressor if attached to flash hider 110. Other exterior features may be provided on flash hider 110 instead of or in addition to these described.

Second portion 150 comprises three tines 152 joined at a base 154 where second portion 150 interfaces with first portion 132. Tines 152 are separated thereafter by gaps 156. Tines 152 are parallel to central bore 118. Tines 152 are also tapered from base 154 to second end 114 of flash hider 10, occupying less and less of the incremental axial volume of flash hider 110 while gaps 156 define more and more of that incremental axial volume. Incremental axial volume is defined as the volume of an axial increment of flash hider 110. Accordingly, in each incremental axial volume of flash hider 110 moving axially from base 154 to second end 114, tines 152 are a smaller and smaller percent of that volume and gaps 156 are a larger and larger percent of that volume than in the preceding incremental axial volume.

Three tines 152 are preferred over a larger or smaller number of tines, as three tines will have sufficient mass and are therefore stronger than a flash hider 110 with a greater number of thinner tines. Also, three tines 152 provide gaps 156 that allow for a sufficient flow rate for the air and combustion gas to move radially from central bore 134 through gaps 156.

Figure 9:
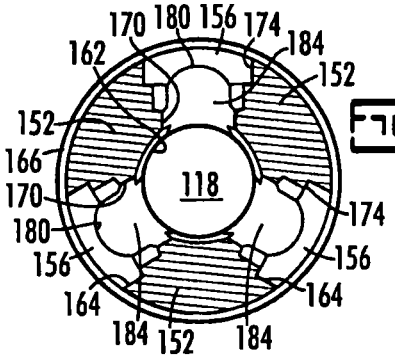
FIG. 9 is an end cross-sectional view of the flash hider of FIG. 3 taken along lines 9-9.
Figure 10:
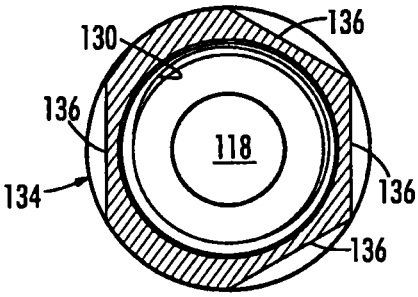
FIG. 10 is a cross-sectional view of a detail of the flash hider of FIG. 4 taken along lines 10-10.
Figure 11:
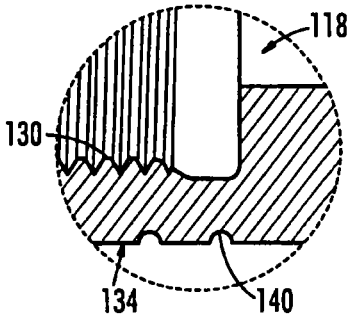
FIG. 11 is a side cross-sectional view of a detail at circle 11 of the flash hider of FIG. 5.
Figure 12:
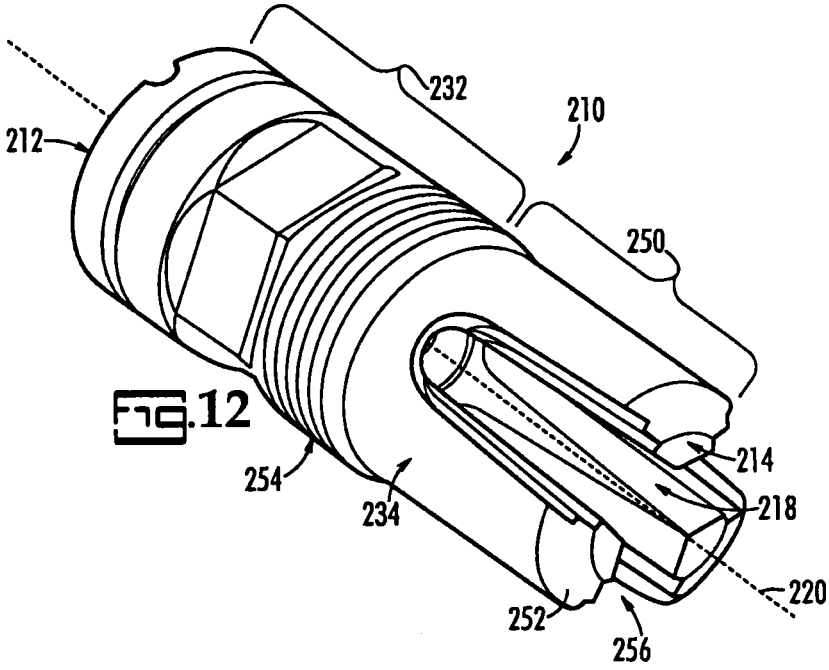
FIG. 12 shows a perspective view from a second end of a flash hider, according to an alternative embodiment of the present invention.
Figure 13:
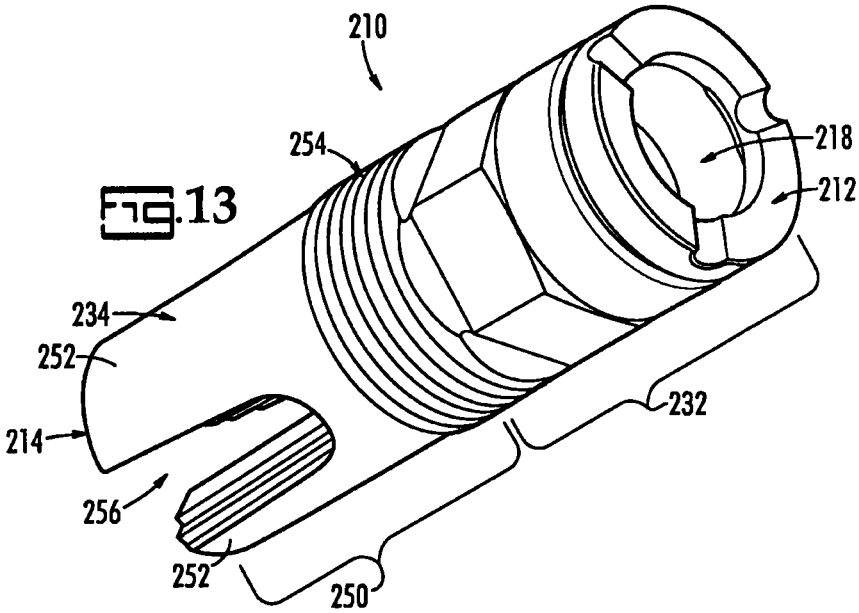
FIG. 13 shows a perspective view from the first end of the flash hider of FIG. 12.
Figure 14:
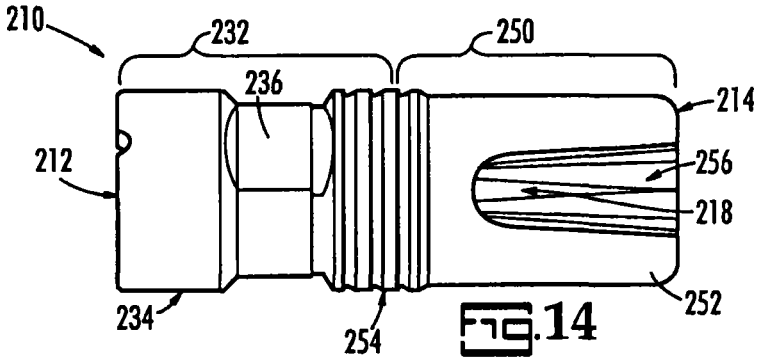
FIG. 14 shows a side view of an embodiment of the flash hider of FIG. 12.
Figure 15:
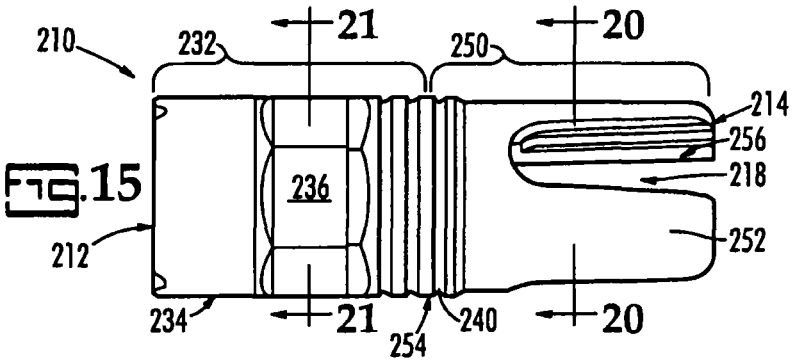
FIG. 15 is a view of the obverse side of the flash hider of FIG. 14.
Figure 16:
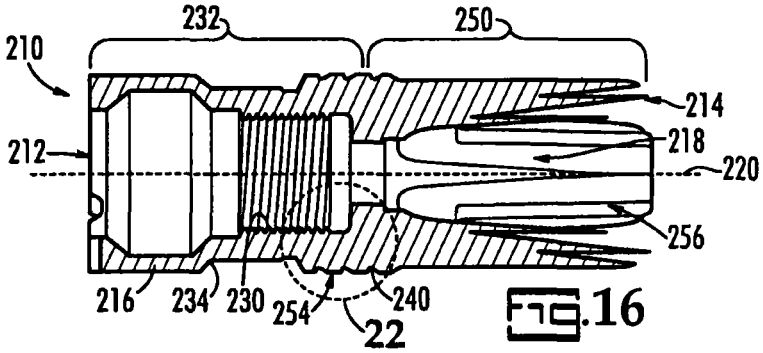
FIG. 16 is a side, cross-sectional view taken along lines 16-16 of FIG. 18, according to the present invention.
Figure 17:
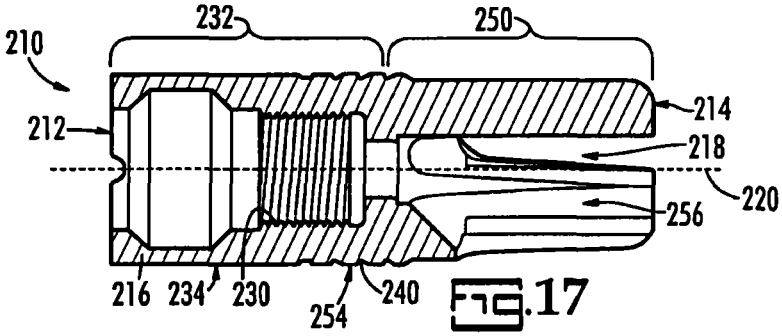
FIG. 17 is a side, cross-sectional view of the flash hider of FIG. 15.
Figure 18:
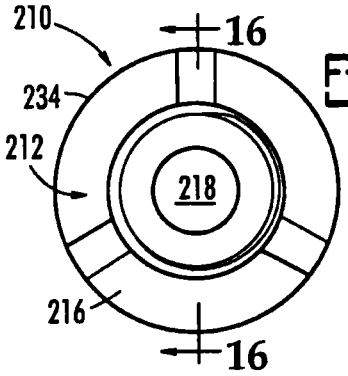
FIG. 18 is an end view of the flash hider of FIG. 13 from the first end.
Figure 19:
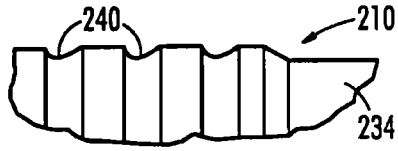
FIG. 19 is a detail of exterior side view of the flash hider of FIG. 12.
Figure 20:
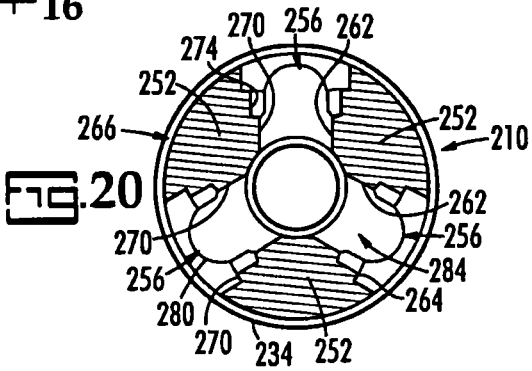
FIG. 20 is an end cross-sectional view of the flash hider if FIG. 15 taken along lines 20-20.
Figure 21:
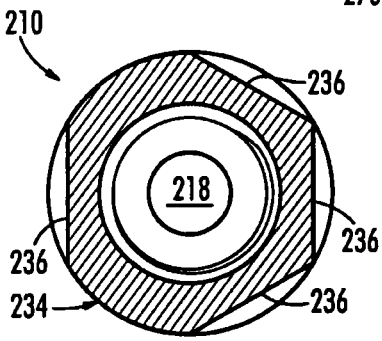
FIG. 21 is a cross-sectional view of the flash hider of FIG. 15.
Figure 22:
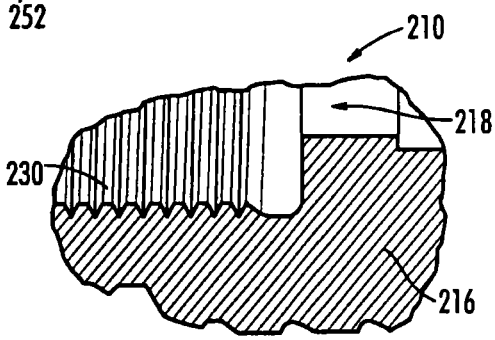
FIG. 22 is a side cross-sectional view of an embodiment of a flash hider taken from circle 22 of FIG. 16.

Tines 152 each have in interior face 162, two lateral faces 164 and an exterior face 166, as best seen in FIG. 9. Interior face 162 comprises the interior surface of wall 116 at central bore 118 and two surfaces 170 flanking central bore 118 at an angle with respect to each other. That angle is preferably less than 180 degrees but greater than 90 degrees with respect to each other and less than 90 degrees with respect to a radius from major axis 120. Two surfaces 170, by being formed at an angle, deflect expanding hot air and combustion gases flowing radially outward from central bore 118 toward the adjacent gaps 156.

Lateral faces 164 have at least one step 174 formed therein, and may have more than one step 174 formed therein. Steps 174 are a series of angled changes from the initial plane of a lateral face 164 from a more or less radial direction to a more or less tangential direction and then back to a more radial direction from central bore 34 so that the incremental width between adjacent tines 152 at any gap 156 widens with each step 174. It is believed that increasing the width between lateral faces 174 of adjacent tines 152 allows the hot gasses to expand, thereby helping to cool them, and that stepwise changes in lateral faces 174 also cause turbulent mixing of the expanding combustion gases with the cooler air outside flash hider 110.

Exterior faces 166 are curved so that exterior faces 166 of all three tines 152 define a generally cylindrical envelope around flash hider 110.

At base 154, tines 152 merge and gaps 156 close to form a joint 180 with a smooth radius when flash hider 110 is viewed from the exterior. See FIGS. 1 and 2. Joint 180 slopes radially inward to central bore 118 at an approximately 45 degree angle with respect to major axis 120 to form an entrance 184 to second portion 150 from first portion 132, as best seen in FIG. 6. The greater the angle of this slope (that is, the more open entrance 184 is), the faster the air will be moved off the centerline of central bore 34, but moving air off-center too quickly may result in a collision of hot combustion gases and the surrounding, cool, still air. The smaller the angle of the slope, the less the shock of the collision with the surrounding air but the longer flash hider 110 needs to be in order to move sufficient air flow off-center to minimize muzzle flash. An angle of 45 degrees is chosen to keep the length of the flash hider 110 reasonable. However, another mechanism is added to facilitate mixing of the combustion gases with the surrounding cool air in the vicinity of flash hider 110, namely steps 174 in lateral faces 164 of tines 152, as described above. The combination of steps 174, widening gaps 156 and the flared entrance 184 cooperate to rapidly move combustion gases radially outward and turbulently mix with the cooler surrounding air to avoid re-combustion of the combustion gases which is a primary cause of secondary muzzle flash.

The opening of central bore 118 forward of the interface of first portion 132 and second portion 150, that is, just forward of the barrel where flash hider 110 is threaded, allows the pulse of barrel air and hot gases resulting from firing the firearm to begin to expand radially away from the major axis 120, thereby decreasing the amount of gas still on the centerline and available for the primary flash, and allowing the laterally moving gas to expand and mix with the cooler surrounding air with the resulting decrease in the temperature of that gas. As the radially-moving gases enter gaps 156, steps 174 facilitate mixing with the static, and much cooler, air surrounding flash hider 110. Without wishing to be bound by theory, it is believed that steps 174 cause the radially moving gases to tumble and swirl while drawing the cooler external air into that swirl thereby accelerating the decrease in the temperature of the mixing gases to a temperature below that which would support re-ignition. Accordingly, the secondary flash is substantially diminished.

The primary flash from the firing of a firearm cannot be prevented as central bore 118 must remain open for the bullet, but it can be reduced by driving relatively more centerline gas flow off axis 120 and radially into gaps 156.

Referring now to FIGS. 12-22, there is shown an alternate embodiment of the present flash hider characterized generally as shorter and intended for use with a firearm that fires a different caliber of ammunition such as 5.56 mm rather than 7.62 mm, such as that intended for flash hider of FIGS. 1-11.

Flash hider 210 shown in FIGS. 12-22 is very similar to that of flash hider 110. It has a first end 212 and an opposing second end 214. It is in the form of a tube with a wall 216 and having a central bore 218 formed there through, dimensioned to pass a bullet along the major axis 220 of flash hider 210. Flash hider 210 has interior threads 230 in a first portion 232 and, on its exterior surface 234, facets 236 for using a wrench to tighted it to the threaded end of the barrel of a firearm. As with flash hider 110, flash hider 210 has an annual recess 238, useful for attaching additional components, and a series of annular grooves 240.

Second portion 250 carries three tines 252 extending from the base 254 of second portion 250. Tines 252 are separated by gaps 256. Each tine 252 has an interior face 262, two lateral faces 264 and an exterior face 266. Interior face 262 comprises in part the inner surface of wall 216 at central bore 218 and two flat surfaces 270 on either side of central bore 218. Surfaces 270 are formed to be at an angle with respect to each other of less than 180 degrees but more than 90 degrees to deflect expanding hot air and combustion gases from central bore 218 toward gaps 256.

As hot air and combustion gas exits flash hider 210 through gaps, they pass by lateral faces 264 on which are formed at least one step 274 each, which step is an angled change in the orientation of face 264 in a direction that results in an increase in the width of gap 256, followed by a second angled change in the orientation in face 264 in a more radially outward direction. With two steps 274, there are four angled changes in the direction resulting in two increases in the width of gap 256. These angled changes in the surfaces of lateral faces 264 provide for more cooling expansion of the hot combustion gases and air from central bore 218, and also are believed to cause turbulent mixing of the radially out-flowing hot combustion gases and air from the barrel with the static, cooler air surrounding flash hider 210 at second portion 250. As a result, the temperature of the out-flowing gas and air falling rapidly and thus re-ignition of those gases is prevented as they exit from flash hider 210.

Flash hider 210 is shorter than flash hider 110, with shorter tines 252 and an interior bore 218 formed to receive a different firearm barrel. Aside from being dimensioned for a different firearm, the length of tines 252 is shorter than tines 152 because the caliber of the ammunition used with flash hider 210 will produce less combustion gas to cool. However, longer tines 252, also help to physically hide any primary flash from all but end viewing.

Those skilled in the art of fire arm design will understand that many modifications and substitutions may be made in the foregoing embodiments without departing from the spirit and scope of the present invention, which is defined by the appended claims.

What is claimed is:

1. A flash hider for use with the barrel of a firearm, said flash hider comprising a generally cylindrical tube with a wall, a first end, an opposing second end, and a central bore there through, said central bore being threaded at said first end and flaring radially between said first end and said second end into gaps formed in said wall of said tube, said gaps leaving tines remaining of said wall at said second end, each tine of said tines having an interior face, an exterior face, and two lateral faces, each lateral face of said two lateral faces facing an adjacent gap of said gaps, said each lateral face having at least one step formed therein so that the width of said gap increases step-wise in the radial direction from said central bore.

2. The flash hider as recited in claim 1, wherein said at least on step is formed in a direction parallel to a radius from said central bore.

3. The flash hider as recited in claim 1, wherein said tines is three tines and said gap is three gaps.

4. A flash hider for use with the barrel of a firearm, said flash hider comprising a generally cylindrical tube with a wall, a first end, an opposing second end, and a central bore there through, said central bore having an axis, said central bore being threaded at said first end and having three gaps formed in said wall of said tube at said second end, said gaps leaving three tines remaining of said wall at said second end, said tines tapering toward said second end, each tine of said three tines having an interior face, an exterior face, and two lateral faces, each lateral face of said two lateral faces facing an adjacent gap of said three gaps, said interior face having two surfaces that direct air from said central bore toward said lateral faces.

5. A flash hider for use with the barrel of a firearm, said flash hider comprising a generally cylindrical tube with a wall, a first end, an opposing second end, and a central bore there through, said central bore having an axis, said central bore being threaded at said first end and having tines at said second end with a gap on either side of each tine of said tines, and wherein said central bore flares radially between said first end and said second end, extending toward said gap formed in said wall of said tube, leaving said tines remaining of said wall at said second end, each tine of said tines having an interior face, an exterior face, and two lateral faces, each lateral face of said two lateral faces facing an adjacent gap of said gaps, said each lateral face having at least one step formed therein so that the width of said gap increases step-wise in the radial direction from said central bore.

6. The flash hider as recited in claim 5, wherein said central bore flares radially at an angle of 45 degrees.

7. A flash hider for use with the barrel of a firearm, said flash hider comprising a generally cylindrical tube with a wall, a first end, an opposing second end, and a central bore there through, said central bore having an axis, said central bore being threaded at said first end, flaring radially between said first end and said second end into three gaps formed in said wall of said tube, said central bore flaring into a joint with said gaps, said joint having a smooth radius, said three gaps leaving three tines remaining of said wall at said second end, each tine of said three tines having an interior face, an exterior face, and two lateral faces, each lateral face of said two lateral faces facing an adjacent gap of said three gaps, said interior face formed to have two surfaces that direct gasses from said central bore toward said lateral faces, said each lateral face having at least one step formed therein so that the width of said gap increases step-wise in the radial direction from said central bore.

8. The flash hider as recited in claim 7, wherein said central bore flares at an angle of 45 degrees.

9. A flash hider for use with the barrel of a firearm, said flash hider comprising a generally cylindrical tube with a wall, a first end, an opposing second end, and a central bore there through, said central bore being threaded at said first end, flaring radially between said first end and said second end into three gaps formed in said wall of said tube, said gaps leaving three tines remaining of said wall at said second end, said three tines tapering toward said second end, each tine of said three tines having an interior face, an exterior face, and two lateral faces, each lateral face of said two lateral faces facing an adjacent gap of said three gaps, said each lateral face having at least one step formed therein so that the width of said gap increases step-wise in the radial direction from said central bore.

10. The flash hider as recited in claim 9, wherein said at least on step is formed in a direction parallel to a radius from said central bore.

11. The flash hider as recited in claim 9, wherein said central bore flares radially at an angle of 45 degrees.

12. A flash hider for use with the barrel of a firearm, said flash hider comprising a generally cylindrical tube with a wall, a first end, an opposing second end, and a central bore there through, said central bore having an axis, said central bore being threaded at said first end and having gaps formed in said wall of said tube at said second end, said gaps leaving tines remaining of said wall at said second end, each tine of said tines having an interior face, an exterior face, and two lateral faces, each lateral face of said two lateral faces facing an adjacent gap of said gaps, said interior face formed to have two surfaces that direct air from said central bore toward said lateral faces, said each lateral face having at least one step formed therein so that the width of said gap increases step-wise in the radial direction from said central bore.

13. The flash hider as recited in claim 12, wherein said at least on step is formed in a direction parallel to a radius from said central bore.

14. The flash hider as recited in claim 12, wherein said tube has an exterior surface and wherein said exterior surface has two opposing facets for use in fastening said flash hider to said barrel of said firearm.

* * * * *